US006409488B1

(12) United States Patent
Ikoma et al.

(10) Patent No.: US 6,409,488 B1
(45) Date of Patent: Jun. 25, 2002

(54) ROTARY COMPRESSOR

(75) Inventors: Mitsuhiro Ikoma; Terumaru Harada, both of Ikoma; Fumitoshi Nishiwaki, Nishinomiya; Hidenobu Shintaku, Neyagawa; Hiroshi Hasegawa, Katano; Etsuro Suzuki, Fujisawa, all of (JP)

(73) Assignees: Matsushita Electric Industrial Co., Ltd.; Matsushita Refrigeration Company, both of Osaka (JP)

( * ) Notice: Subject to any disclaimer, the term of this patent is extended or adjusted under 35 U.S.C. 154(b) by 0 days.

(21) Appl. No.: 09/664,311

(22) Filed: Sep. 18, 2000

Related U.S. Application Data

(62) Division of application No. 08/891,155, filed on Jul. 10, 1997, now Pat. No. 6,132,195.

(30) Foreign Application Priority Data

| | | |
|---|---|---|
| Jul. 10, 1996 | (JP) | 8-180269 |
| Sep. 18, 1996 | (JP) | 8-245856 |
| Nov. 19, 1996 | (JP) | 8-307588 |

(51) Int. Cl.[7] ..... F04C 18/44
(52) U.S. Cl. ..... 418/67
(58) Field of Search ..... 418/67

(56) References Cited

U.S. PATENT DOCUMENTS

| | | | | |
|---|---|---|---|---|
| 2,246,271 A | 6/1941 | Davidson | | 418/76 |
| 2,422,972 A | 6/1947 | Knowles | | 418/77 |
| 2,800,274 A | 7/1957 | Makaroff et al. | | 418/67 |
| 5,616,019 A | 4/1997 | Hattori et al. | | 418/67 |

FOREIGN PATENT DOCUMENTS

| | | | | |
|---|---|---|---|---|
| JP | 55-180 989 | | 12/1980 | |
| JP | 3-100391 | * | 4/1991 | 418/67 |
| JP | 4-228 894 A | | 8/1992 | 418/67 |
| JP | 4-255591 | * | 9/1992 | 418/67 |
| JP | 6-257 579 | | 9/1994 | 418/67 |
| JP | 7-259 767 | | 10/1995 | |

OTHER PUBLICATIONS

Kawahira, *Sealed Tye Refrigerator*, Fig. 6.1, 1993, p. 13.

* cited by examiner

*Primary Examiner*—John J. Vrablik
(74) *Attorney, Agent, or Firm*—Smith, Gambrell & Russell, LLP

(57) ABSTRACT

A rotary compressor has a cylinder, a crank shaft having an eccentric part disposed in said cylinder, a bearing which rotatably supports said crank shaft, a roller which moves in said cylinder following said eccentric part, and a vane whose all or part of the tip is of R configuration, wherein a groove with which the vane tip is disposed in contact is provided on the outer periphery of said roller, a first oil groove is provided on the end face of said roller, and said roller is provided with an oil hole communicating said first oil groove and said groove of the roller.

5 Claims, 16 Drawing Sheets

ROTARY COMPRESSOR

This application is a division of allowed application Ser. No. 08/891,155 filed Jul. 10, 1997, U.S. Pat. No. 6,132,195, which is incorporated herein by reference.

BACKGROUND OF THE INVENTION

1. Field of the Invention

The present invention relates to a rotary compressor to be used for the refrigerators, air conditioners, and the like.

2. Related Art of the Invention

Rotary compressors are much utilized for the refrigerators, air conditioners, and the like, because of their compact size and simple structure. The compression mechanism parts such as vane and roller which are the major constituting parts of the compressor are described in, for example, KAWAHIRA, "Sealed type refrigerator" (1993) P.14, FIG. 6.1.

Hereinafter, using FIG. 6, constitution and operation of the conventional rotary compressor are explained. The compression mechanism part in the sealed container comprises a crank shaft 101 having an eccentric part 109, a bearing supporting the crank shaft 101, a cylinder 102, a vane 103, and a roller 104 which eccentrically rotates in the cylinder 102. The vane 103 having a cylindrical tip reciprocates in the vane slot 105 of the cylinder 102, and its tip part is pressed to the outer peripheral surface of the roller 104 by the spring force by the spring 106 and the pressure difference between inside and outside of the cylinder 102 to slide in contact with the outer peripheral part of the roller 104, thereby dividing the inner part of the cylinder 102 into the suction chamber 107 and the discharge chamber 108. The part O is a center of the cylinder 102 and the crank shaft 101. The crank shaft 101 has an eccentric part 109 centering on the point P which is eccentric by e from the center O. The crank shaft 101 rotates centering on O, and along with it the eccentric part 109 integral with the rank shaft rotates eccentrically. The roller 104 is engaged in the eccentric part 109. Due to the rotation of the crank shaft 101 by the electric motor and the revolution of the roller 104 in the cylinder 102, refrigerant gas is taken in from the suction port 110 and sent to the discharge port 111 while being compressed. The refrigerant gas from the discharge port 111 is sent to the refrigeration cycle side through the discharge valve 112, and passed through the condenser, expansion valve, and evaporator to return to the suction port 110 of the compressor again.

In the above constitution, at the contact part between the roller 104 and the tip part of the vane 103, an oil film has been formed by the oil which is mainly contained in the intake refrigerant and the oil which passes through the gap between the vane 103 and the vane slot 105 provided on the cylinder 102 or the gap between the end face of the roller 104 by the pressure difference.

The sealed container, bearing to support the crank shaft 101, and electric motor are not illustrated.

However, according to the conventional constitution as above, as the tip part of the vane 103 has a cylindrical curved surface and the outer peripheral surface of the roller 104 is also cylindrical, the contact condition between the vane 103 and the roller 104 is equivalently the contact between the small cylinder and the large cylinder. Accordingly, the contact condition is a line contact condition wherein the contact area is smaller, and the load per unit area, i.e., contact stress, is larger, so that the contact sliding conditions between the vane 103 and the roller 104 become rigorous.

The number of autorotations of the roller 104 is also determined by the difference of the friction resistances between the inner peripheral surface and the eccentric part 109 and those between the outer peripheral surface of the roller 104 and the tip of the vane 103 and the like. The number of autorotations of the roller 104 is very unstable. In general, when the crank shaft 101 is operated at the revolution of 3500 rpm, the number of autorotations of the roller is about several scores to several hundreds rpm.

Because of the above, on the sliding surfaces of the tip of the vane 103 and the roller 104 the sliding speeds vary depending on conditions, and sliding movements become unstable.

Moreover, there is a problem that, in case of the use of the chlorine-free alternative refrigerant, e.g., R134a, remarkable lowering of lubrication occurs, and especially in case of the rotary compressor, wear is apt to occur between the outer periphery of the roller 104 and the tip of the vane where an oil film is less apt to be formed.

In order to settle the above points, for example, Japanese Patent Laid-open HEI 7-259767 discloses such construction that there are a horizontal hole 116 thrusting through the inside of the crank shaft 101 and its eccentric part 109 from the oil feed passage 115 to the outer diameter of the eccentric part 109, an oil groove 117 provided on the outer diameter part of said eccentric part 109 in communication with the horizontal hole 116, a groove 121 provided on the outer periphery of the roller 104, a hole 120 thrusting through said outer peripheral groove 119 provided in parallel with said groove 119 at the deepest part of the groove 119 and a vane 103 is applied to the groove 119.

According to said constitution, the contact between the roller 104 with the vane 103 becomes face contact and the autorotation of the roller 104 is also restricted, and stable sliding conditions can be realized. However, the oil supply to the contact part between the roller 104 and the vane 103 becomes intermittent because the hole 120 thrusting through from the inner diametrical part of the roller comes to be communicated with the side hole 116 provided to lead to the outer diametrical part of the eccentric part from the oil supply passage 115 only once in a turn. Therefore, no sufficient oil is supplied. Another drawback is that the oil to be supplied to the sliding part between the eccentric part 109 and the inner periphery of the roller 104 shows decrease.

In the first invention, in consideration of the points of the conventional compressors as shown in FIG. 7, an object is to provide a highly reliable, long life rotary compressor by reduced sliding load between the vane and the roller and supply of sufficient oil to the sliding part between the vane and the roller.

On the other hand, according to the constitution of the conventional compressor as in the above FIG. 7, the sliding conditions between the vane 103 and the roller 104 are improved, but the oil supply to the contact part between the roller 104 and the vane 103 involves drawbacks due to the complicated routes intervened by many relay points as described above, thus requiring complicated processing, having tendency to cause pooling of gases and difficulty of stabilized oil supply. Moreover, there has been no consideration given to the measures to be taken against the extremely large force applied to the inner peripheries of the eccentric part 109 and the roller 104 from the latter half part of the compression process.

The second invention is to settle the points of the conventional compressor of FIG. 7. It aims at providing a more reliable, long life rotary compressor which is easily processed, does not give ill affect on other sliding part, assures stabilized oil supply, and permits reliable sliding and lubrication between the vane and the roller.

On the other hand, with respect to the groove part 119 of the conventional compressor shown in FIG. 7 above, as shown in FIG. 17, in case of the contact sliding between the tip R part of the vane 103 and the groove 119 of the roller 103 according to the eccentric rotation of the roller 104, if there are always or temporarily in the groove 119 the edge 122 on the suction chamber 107 side of the vane 103 and the edge 123 on the discharge chamber 108 side (the edge refers to the crossing part between the R part and the side surface), they have possibility to wear the groove part 119. Also, due to the pressure difference between the suction chamber 107 side of the vane 103 and the discharge chamber 108 side, at the groove part 119 the surface pressure on the suction chamber 107 side becomes higher than on the discharge chamber 108 side. Accordingly, the sliding movement conditions become severer on the suction chamber 107 side edge 122 than on the discharge chamber 108 side edge 123. The parts 124 and 125 are the shoulders of the groove 119, and the part 126 is a center of the part R of the vane 103.

With the object of solving the points of the conventional compressor as shown in FIG. 7, the third invention aims at providing a highly reliable rotary compressor wherein prevention is made of the contact sliding between at least the edge on the suction chamber side of the vane with the groove.

An object of the fourth invention is to provide, in order to solve the points of the conventional compressor as shown in FIG. 7, a more highly reliable, long life rotary compressor with reduced load of the sliding part between the vane and the roller, and assured lubrication of the sliding part between the vane and the roller, by realizing the constitution of separate embodiment from the third invention.

Recently, with the object of protecting ozone layer, there has come to be used a chlorine-free alternative refrigerant (e.g., R-134a). In the conventional compressor of FIG. 7, such a chlorine-free alternative refrigerant gives further unsatisfactory sliding condition in comparison with the refrigerant containing chlorine. Accordingly, it is necessary to provide severer restriction on the conditions for the use of the compressor or to develop a sliding material having improved abrasion resistance performance.

The first to the fourth inventions referred to above are each intended to solve the points of the conventional compressors as above.

SUMMARY OF THE INVENTION (A) The first invention comprises a cylinder, a crank shaft having an eccentric part disposed in said cylinder, a bearing which rotatably supports said crank shaft, a roller which moves in said cylinder following said eccentric part, and a vane whose all or part of the tip is of R configuration, with the constitution that a groove with which the vane tip is disposed in contact is provided on the outer periphery of said roller, a first oil groove is provided on the end face of said roller, and said roller is provided with an oil hole communicating said first oil groove and said groove of the roller.

The invention may be a rotary compressor characterized in that the second oil groove is an oil groove provided along the direction not in parallel with said groove.

The invention may be a rotary compressor characterized in that the first oil groove is installed on the end faces of both sides of upper and lower parts of the roller.

The invention may be a rotary compressor characterized in that the oil holes are plural in number.

The invention may be a rotary compressor characterized in that the roller is provided at its end face with a horizontal groove from said first oil groove to said inner periphery of the roller.

The invention may be a rotary compressor characterized in that the horizontal grooves are plural in number.

(B) The second invention comprises a cylinder, a crank shaft having an eccentric part disposed in said cylinder, a bearing which rotatably supports said crank shaft, a roller which moves in said cylinder following said eccentric part, and a vane whose all or part of the tip is of R configuration, with the constitution that a groove with which the vane tip is disposed in contact is provided on the outer periphery of said roller, and at least one flow passage is provided communicating from said groove to the light load side of the inner peripheral surface of said roller.

The invention may be a rotary compressor characterized in that said flow passage is provided in inclination to the suction chamber side rather than the center axis of reciprocal movements of the vane.

The invention may be a rotary compressor characterized by comprising a cylinder, a crank shaft having an eccentric part disposed in said cylinder, a bearing which rotatably supports said crank shaft, a roller which moves in said cylinder following said eccentric part, a vane whose all or part of the tip is of R configuration, a groove having substantially the same curvature as at the tip of said vane and with which the tip of said vane is in contact, disposed on the outer peripheral surface of said roller, an oil chamber formed of said roller, end face of said bearing, and said eccentric part, and a flow passage for oil supply having a width smaller than that of said vane on one or both sides of said roller, or on one or both of the bearing end faces with which the side surface of said vane is in contact, so as to communicate from said groove part to the oil chamber on the inner periphery of said roller.

The invention may be a rotary compressor characterized by comprising a cylinder, a crank shaft having an eccentric part disposed in said cylinder, a bearing which rotatably supports said crank shaft, a roller which moves in said cylinder following said eccentric part, a vane whose all or part of the tip is of R configuration, a groove having substantially the same curvature as at the tip of said vane and with which the tip of said vane is in contact, disposed on the outer peripheral surface of said roller, a flow passage communicating from the end face of the bearing with which the side surface of said vane is in contact to an oil chamber and an oil passage having a width smaller than the thickness of said vane, provided on the side surface of said vane or on the end face of said bearing with which said vane is in contact so as to be in communication with said flow passage.

(C) The third invention is characterized by having a structure that the edge at the tip of the vane does not come into contact with the groove part.

The invention may be a rotary compressor characterized by comprising a cylinder, a crank shaft having an eccentric part, a bearing which rotatably supports said crank shaft, a roller which moves in said cylinder following said eccentric part, a vane whose all or part of the tip is of R configuration, and a groove having substantially the same curvature as at the tip of said vane and with which the tip of said vane is in contact, disposed on the outer peripheral surface of said roller, with the R part at the tip of said vane being disposed swingably in the groove, wherein, assuming the swing angle of said roller to be $\xi$, the center angle of R part at the tip of the vane to be $\alpha$, and the center angle of said groove part taken from the center of the R part at the tip of said vane to be $\beta$, a relation of $\alpha/2-\beta/2>\xi$ is satisfied between them.

The invention may be a rotary compressor characterized by comprising a cylinder, a crank shaft having an eccentric part, a bearing which rotatably supports said crank shaft, a roller which moves in said cylinder following said eccentric part, a vane whose all or part of the tip is of R configuration, and a groove having substantially the same curvature as at the tip of said vane and with which the tip of said vane is in contact, disposed on the outer peripheral surface of said roller, with the R part at the tip of said vane being disposed swingably in the groove, wherein the R part is provided on said groove shoulder part so that the edge of the vane which is a crossing point of said vane side surface to said R part at the tip of the vane does not come into contact with said groove during the rotation of said crank shaft.

The invention may be a rotary compressor characterized by comprising a cylinder, a crank shaft having an eccentric part, a bearing which rotatably supports said crank shaft, a roller which moves in said cylinder following said eccentric part, a vane whose all or part of the tip is of R configuration, and a groove having substantially the same curvature as at the tip of said vane and with which the tip of said vane is in contact, disposed on the outer peripheral surface of said roller, with the R part at the tip of said vane being disposed swingably in the groove, wherein the center position of the R part at the tip of said vane is nearer to the discharge chamber side than the center in the direction of thickness of said vane so that the said edge on the suction chamber side of the vane is always outside of said groove (and does not come into contact with said groove) during the rotation of said crank shaft.

The present invention may be a rotary compressor wherein the R part is provided on the shoulder of the groove part on the discharge chamber side.

(D) The fourth invention is a rotary compressor characterized by comprising a cylinder, a crank shaft having an eccentric part, a bearing which rotatably supports said crank shaft, a roller which moves in said cylinder following said eccentric part, a vane whose all or part of the tip is of R configuration, and a groove having substantially the same curvature as at the tip of said vane and with which the tip of said vane is in contact, disposed on the outer peripheral surface of said roller, with the tip of said vane being disposed slid ably in said groove, and a wedge shaped gap formed in the sliding direction with the tip of said vane.

The present invention may be a rotary compressor wherein the radius of an R shaped groove is slightly larger than the R at the tip of said vane is provided on the outer peripheral surface of said roller.

The present invention may be a rotary compressor wherein the radius Rv of the R at the tip of said vane and the radius Rr of said groove part are constituted in the relations of:

$$0<(Rr-Rv)/Rr<0.1$$

The present invention may be a rotary compressor wherein an R processing different from the central part or chamfering is provided at the tip of the vane positioned on the lateral side of the vane in the vane tip configuration, and said wedge shaped gap is formed between said R processed or chamfered part and said R shaped groove.

The present invention may be a rotary compressor wherein R processing or chamfering is provided at the crossing part of the R part of said groove and the outer peripheral surface of said roller.

The present invention may be a rotary compressor characterized by comprising a cylinder, a crank shaft having an eccentric part, a bearing which rotatably supports said crank shaft, a roller which moves in said cylinder following said eccentric part, a vane whose all or part of the tip is of R configuration, and a groove having substantially the same curvature as at the tip of said vane and with which the tip of said vane is in contact, disposed on the outer peripheral surface of said roller, and the softer one in hardness out of the groove of said roller and the tip of said vane may be constituted by a material of good fitting.

The present invention may be a rotary compressor characterized by comprising a cylinder, a crank shaft having an eccentric part, a bearing which rotatably supports said crank shaft, a roller which moves in said cylinder following said eccentric part, a vane whose all or part of the tip is of R configuration, and a groove having substantially the same curvature as at the tip of said vane and with which the tip of said vane is in contact, disposed on the outer peripheral surface of said roller, and the surface of the hard one in hardness out of the tip of said vane and groove of said roller is finished into smoother than the other (smaller surface roughness).

(E) The present invention may be, in each of the inventions described above, a rotary compressor having a flat surface on a part of the longitudinal length or full length of the R shaped part at the tip of said vane.

The present invention may be, in each of the inventions described above, one furnished with fine oil grooves on a part of the longitudinal length or full length of the contact part between said groove and said vane tip.

The present invention may be, in each of the inventions described above, one driven by using a refrigerant not containing chlorine.

DESCRIPTION OF MARKS

1 crank shaft; 2 eccentric part; 3 cylinder; 4 vane; 5 roller; 6 groove; 7 first oil groove; 8 oil feed passage; 9 oil feed hole; 10 side groove; 11 vertical oil hole; 12 side oil hole; 13 oil hole; 14 flat surface; 15 oil feed hole; 16 oil groove; 17 oil chamber; 18 oil feed hole; 19 oil chamber; 20 flow passage; 21 fine oil hole; 22 main bearing; 23 sub-bearing; 24 flow passage; 25 refrigerator oil; 26 fine oil hole; 27 suction chamber; 28 discharge chamber; 29 fine oil groove; 30 edge; 31 edge; 32 center; 33 shoulder; 34 shoulder; 35 R part; 36 R part; 37 spring; 38, 39 gaps.

PREFERRED EMBODIMENTS

Hereinafter, each embodiment of the first invention will be illustrated with reference to FIGS. 1 to 5.

(Embodiment 1)

Figure 1:
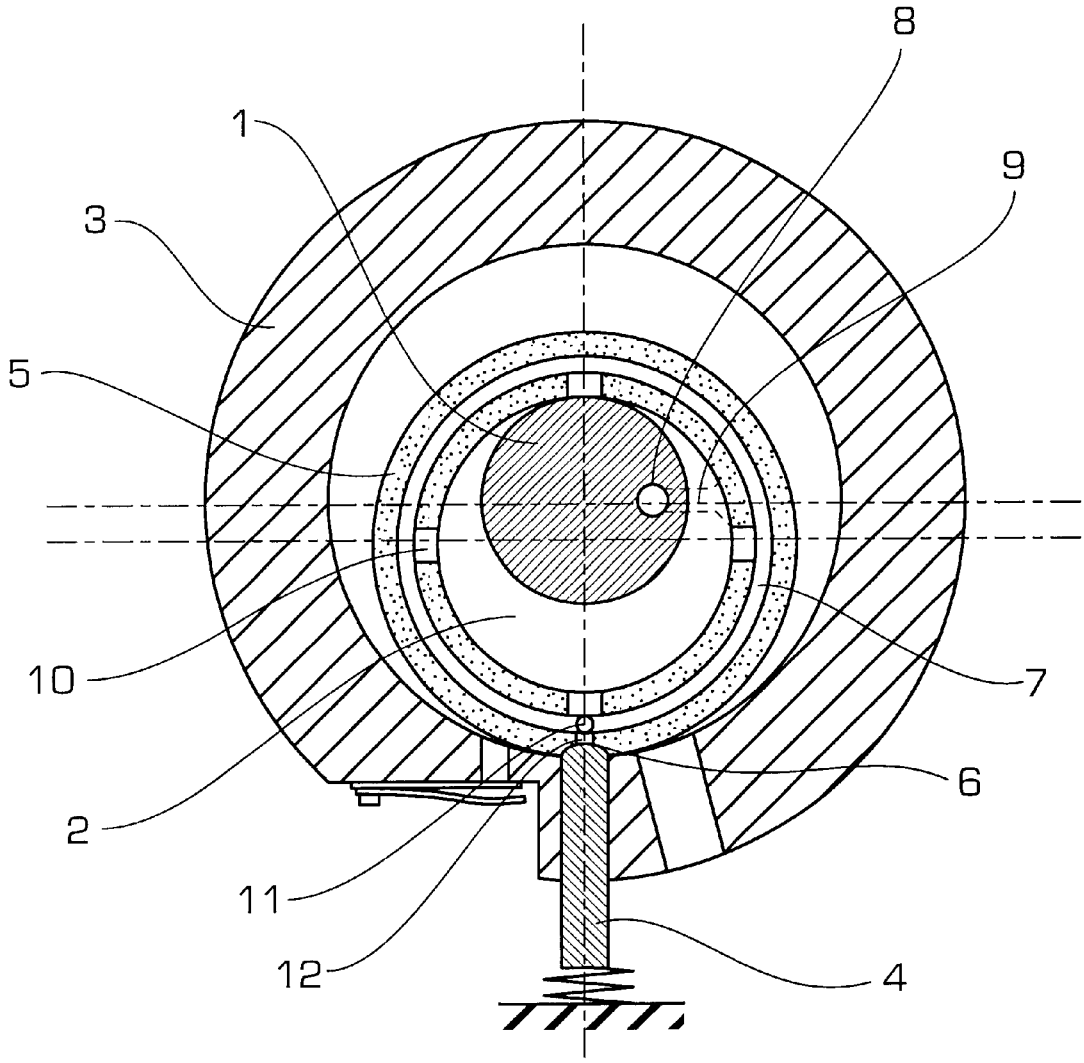
FIG. 1 is a sectional view of a compression mechanical part of the rotary compressor according to the embodiments 1, 2, 3, and 4 of the first invention.
Figure 2:
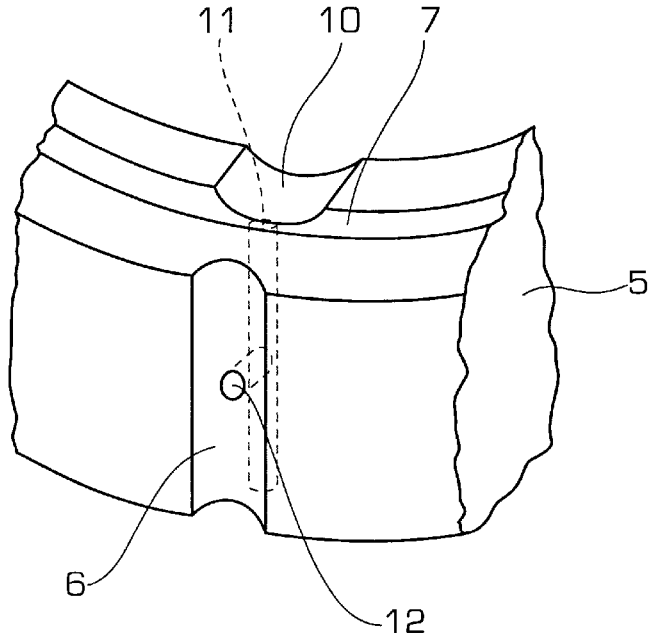
FIG. 2 is a perspective view of the rotary compressor according to the embodiments 1, 2, 3, and 4 of the first invention.

FIG. 1 is a sectional view showing a compression mechanism part of the rotary compressor according to an embodiment of the present invention, and FIG. 2 is a perspective view of the essential part thereof. In FIG. 1 and FIG. 2, the compression mechanism part comprises a crank shaft 1, a cylinder 3, a vane 4 of R shaped tip, and a roller 5 which revolves in the cylinder 3. On the outer periphery of the roller 5 there is formed a groove 6, with which the tip of the vane 4 is set in contact. Further, at the end face of the roller 5 there are provided an oil groove 7 and a side groove 10. The oil feed hole 9 thrusts through the inside of the crank shaft 1 and the eccentric part 2 from the oil feed passage 8 to the outer periphery of the eccentric part 2, so that the oil led from the oil feed passage 8 to the outer periphery of the eccentric part 2 is led to the oil groove 7 by the gap between the end face of the roller 5 and the side wall (not illustrated) of the upper and lower cylinder, and the side groove 10. Also, a vertical oil hole 11 and a horizontal oil hole 12 are provided to communicate the oil groove 7 with the groove 6 of said roller 5.

Next, the operation of the oil supply mechanism in this embodiment is explained. The oil is led to the sliding part of the eccentric part 2 through the oil feed hole 9 from the oil feed passage 8, after which it is led to the oil groove 7 through the gap between the end face of the roller 5 and the side wall of upper and lower cylinder (not illustrated) and a side groove 10 provided on the end face of the roller 5, and further led almost continuously to the groove 6 of the roller 5 through the vertical oil hole 11 and horizontal oil hole 12.

In this manner, in (Embodiment 1), it is possible to supply almost continuously sufficient oil to the sliding part between the vane and the roller where wear is apt to occur due to the severe sliding conditions, to give sufficient oil film formation, and to reduce the sliding load, thereby providing a highly reliable, long life rotary compressor.

(Embodiment 2)

Figure 3:
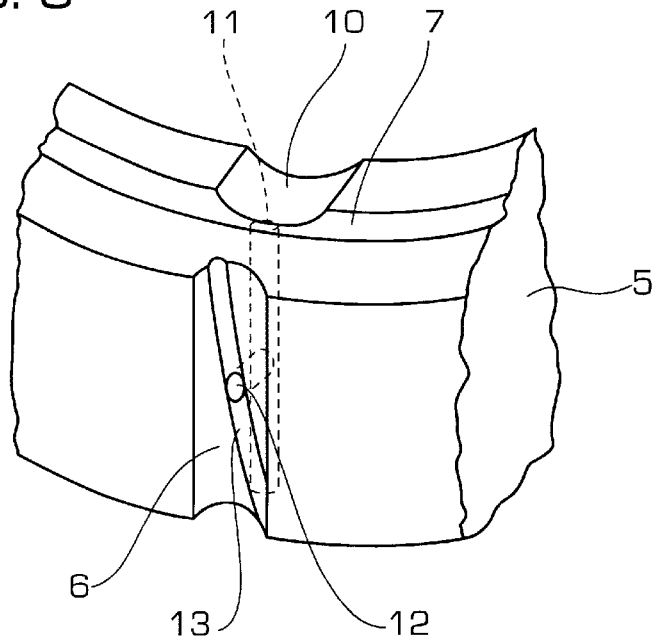
FIG. 3 is a perspective view of an essential part of the rotary compressor according to the embodiment 2 of the first invention.

FIG. 3 is a perspective view of an essential part of the rotary compressor according to an embodiment of the prevent invention. In FIG. 3, the oil groove 13 is provided in the groove part 6 of the roller 5 along the direction not in parallel with the groove 6. Other part constitutions are same as those of FIG. 1 and FIG. 2.

Next, the operation of the oil feed mechanism in this embodiment is explained. In the rotary compressor constituted as in this embodiment, the oil is led to the sliding part of the eccentric part 2 from the oil feed passage 8 through the oil feed hole 9, after which it is led to the oil groove 7 through the gap between the end face of the roller 5 and the upper and lower side wall of cylinder (not illustrated) and a side groove 10 provided on the end face of the roller 5, and further led almost continuously to the oil groove 13 in the groove 6 of the roller 5 through the vertical oil hole 11 and horizontal oil hole 12.

In this manner, in (Embodiment 2), it is possible to supply sufficient oil to almost the whole zone of the sliding part between the vane 4 and the roller 5, to give sufficient oil film formation, and to reduce the sliding load, thereby providing a highly reliable, long life rotary compressor.

(Embodiment 3)

Figure 4:
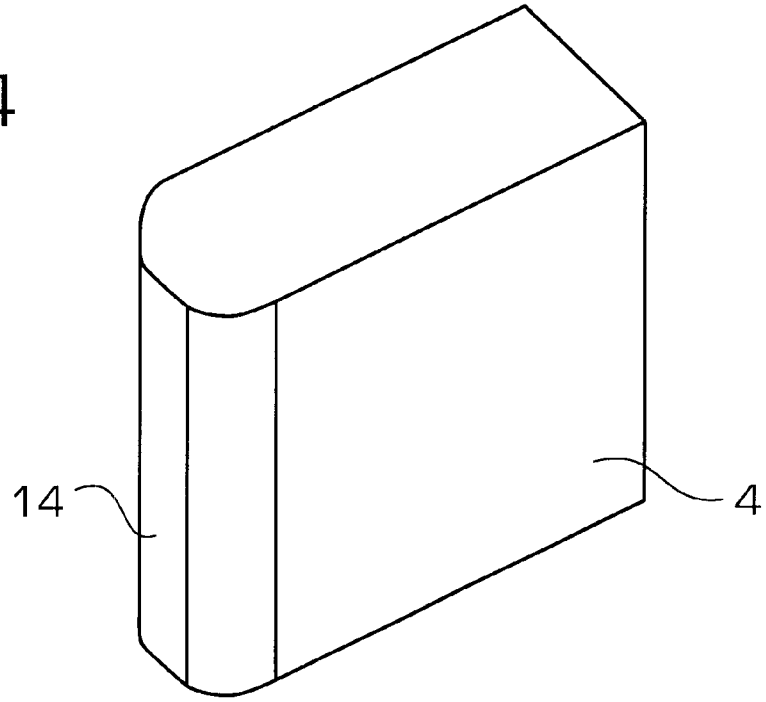
FIG. 4 is a perspective view of an essential part of the rotary compressor according to the embodiment 3 of the first invention.

FIG. 4 is a perspective view of an essential part of the rotary compressor according to an embodiment of the present invention. In FIG. 4, at the top of the R shaped tip of the vane 4 there is formed a flat surface 14. Other part constitutions are same as those of FIG. 1 and FIG. 2.

Next, the operation of the oil feed mechanism in this embodiment is explained. In the rotary compressor constituted as in this embodiment, the oil is led to the sliding part of the eccentric part 2 from the oil feed passage 8 through the oil feed hole 9, after which it is led to the oil groove 7 through the gap between the end face of the roller 5 and the upper and lower side wall of cylinder (not illustrated) and a side groove 10 provided on the end face of the roller 5, and further led almost continuously to the gap between the groove 6 of the roller 5 and the flat surface 14 of the R shaped tip of the vane 4 through the vertical oil hole 11 and horizontal oil hole 12.

In this manner, in (Embodiment 3), it is possible to supply sufficient oil to almost the whole zone of the sliding part between the vane 4 and the roller 5, to give sufficient oil film formation, and to reduce the sliding load, thereby providing a highly reliable, long life rotary compressor.

(Embodiment 4)

Figure 5:
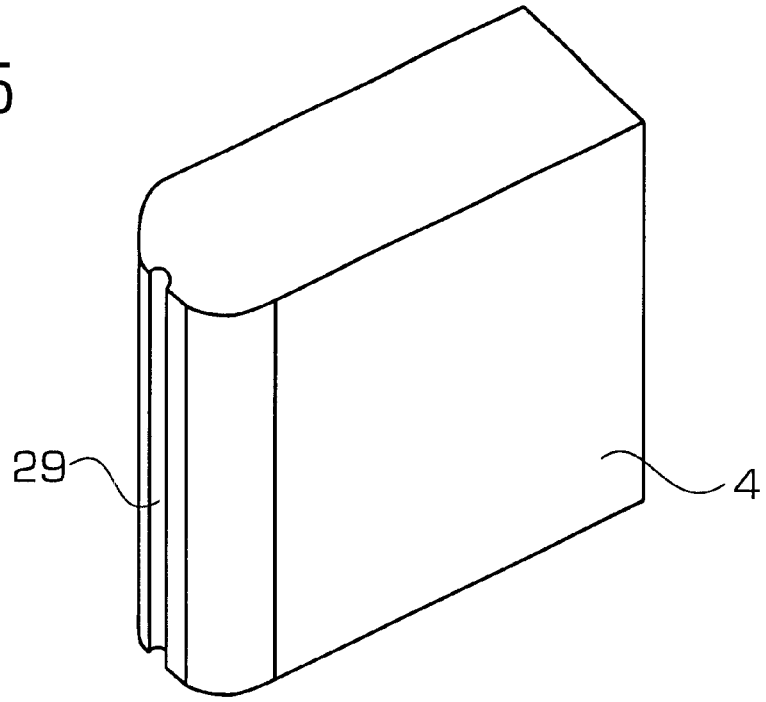
FIG. 5 is a perspective view of an essential part of the rotary compressor according to the embodiment 4 of the first invention.
Figure 6:
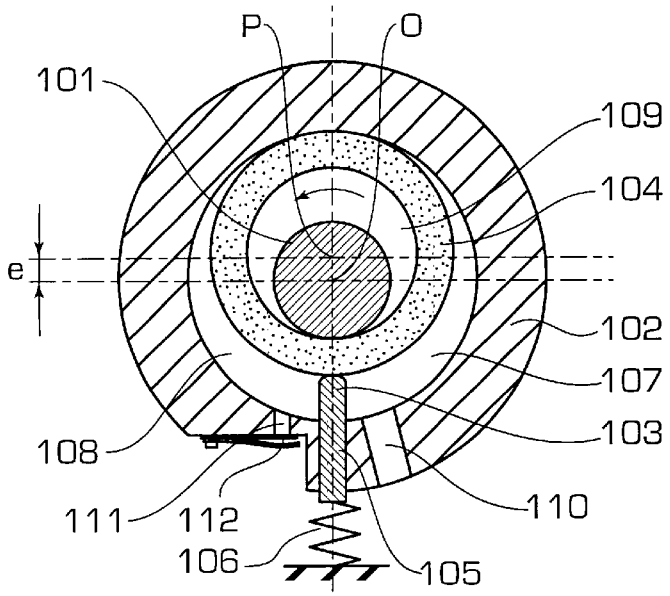
FIG. 6 PRIOR ART
FIG. 6 is a sectional view of a compression mechanical part of the conventional rotary compressor.
Figure 7:
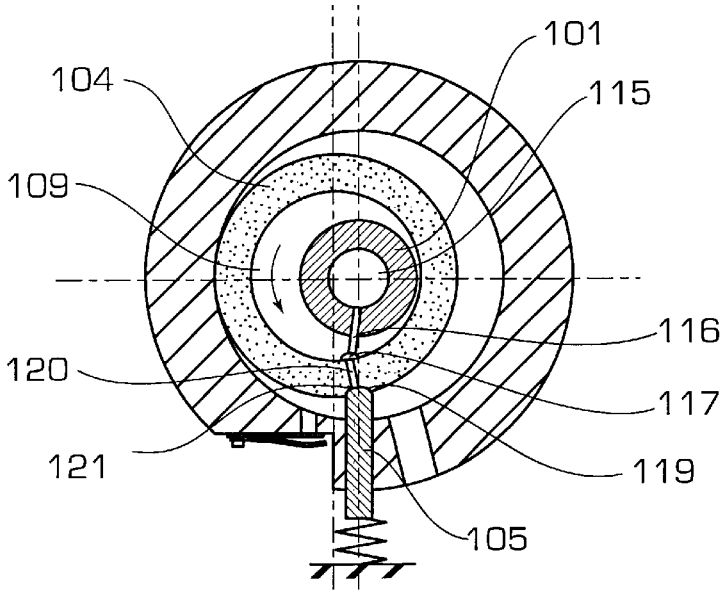
FIG. 7 PRIOR ART
FIG. 7 is a sectional view of a compression mechanical part of the conventional rotary compressor.

FIG. 5 is a perspective view of an essential part of the rotary compressor according to an embodiment of the present invention. In FIG. 5, at the top of the R shaped tip of the vane 4 there is formed fine oil groove 29. Other part constitutions are same as those of FIG. 1 and FIG. 2.

Next, the operation of the oil feed mechanism in this embodiment is explained. In the rotary compressor constituted as in this embodiment, the oil is led to the sliding part of the eccentric part 2 from the oil feed passage 8 through the oil feed hole 9, after which it is led to the oil groove 7 through the gap between the end face of the roller 5 and the upper and lower side wall of cylinder (not illustrated) and a side groove 10 provided on the end face of the roller 5, and further led almost continuously to the groove 6 of the roller 5 and to the oil groove 29 provided on the R shaped part at the tip of the vane 4 through the vertical oil hole 11 and horizontal oil hole 12.

In this manner, in (Embodiment 4), it is possible to supply sufficient oil to almost the whole zone of the sliding part between the vane 4 and the roller 5, to give sufficient oil film formation, and to reduce the sliding load, thereby providing a highly reliable, long life rotary compressor.

The oil groove 7 may be provided not only on the end face of one side of the roller 5 but also on the end faces on both upper and lower sides.

The horizontal groove 10 may not be single but plural number.

The vertical oil hole 11 and horizontal oil hole 12 may not be limited to a single but plural in number.

The operation may be performed by using a chlorine-free refrigerant, e.g., HFC134a.

The oil groove 7 is an example of the first oil groove of the present invention, the oil groove 13 is that of the second oil groove of the present invention, and further the oil groove 29 is that of the third oil groove of the present invention.

The eccentric part 2 is an example of the eccentric part according to the present invention.

As described above, according to the first invention, a highly reliable, long life rotary compressor can be provided.

Hereinafter, each embodiment of the rotary compressor according to the second invention will be explained.

The constitution of the rotary compressor according to an embodiment of the present invention is approximately the same as that of the conventional compressor, except a part such as a groove.

(Embodiment 1)

Hereinafter, Embodiment 1 of the present invention will be illustrated with reference to FIG. 8 and FIG. 9.

Figure 8:
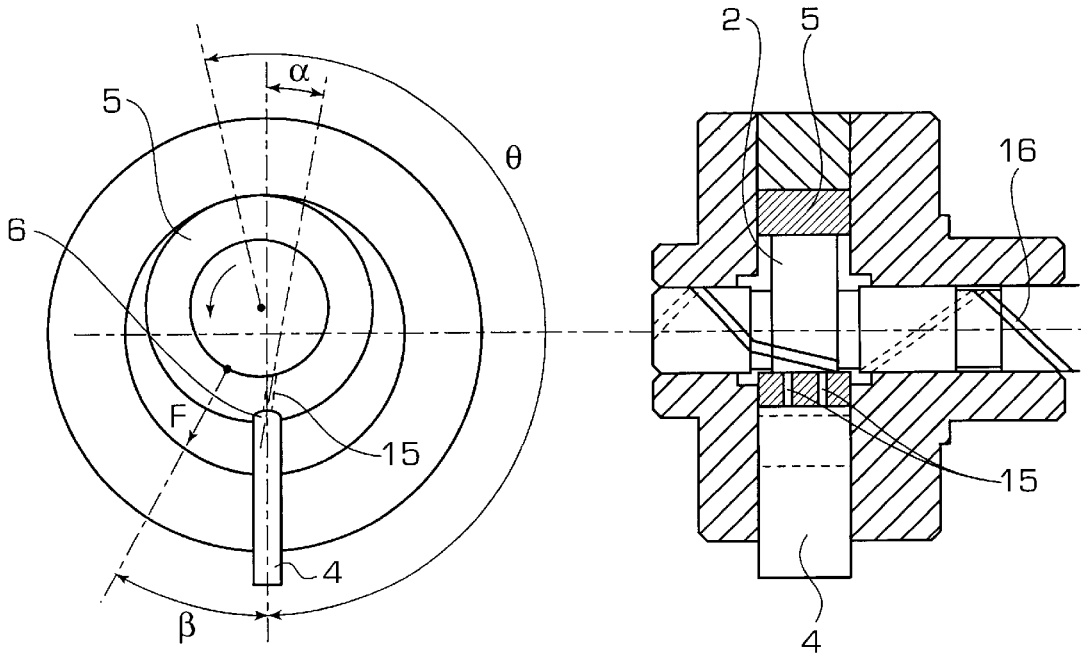
FIG. 8 is a partial sectional view showing the constitution of the mechanical part of the rotary compressor of the embodiment 1 of the second invention.

As shown in FIG. 8, the rotary compressor has such constitution that an R shaped groove 6 is provided on a part of the roller 5, the tip of the vane 4 having approximately the same curvature is swingably arranged on the groove 6, an oil feed hole 15 is provided in communication with the light load side inclined to the suction chamber side more than the center axis of reciprocating movement of the vane 4 toward the inner periphery of the roller 5 from the groove 6, and an oil groove 16 for feeding the refrigerator oil to each sliding part is formed on the outer periphery of the crank shaft 1 and the eccentric part 2.

When the above constitution is adopted, on rotation of the crank shaft 1 the roller 5 revolves (eccentric swinging movement) in the cylinder 3 according to the movement of the eccentric part 2, and the refrigerator oil flows through the oil groove 16 by the pumping force utilizing the centrifugal force and viscosity and fed to each sliding part. A part of the oil is led through the oil feed hole 15 to the sliding surface of the tip of the vane 4 and the groove 6. In this manner, the oil supply to the sliding surface of the tip of the vane 4 and the groove 6 is made through a very simple channel of passing through the oil feed hole 15 from the oil groove 16 in which high pressure refrigerator oil is led at all times, so that the gas is less apt to be pooled, and processing is simple.

Figure 9:
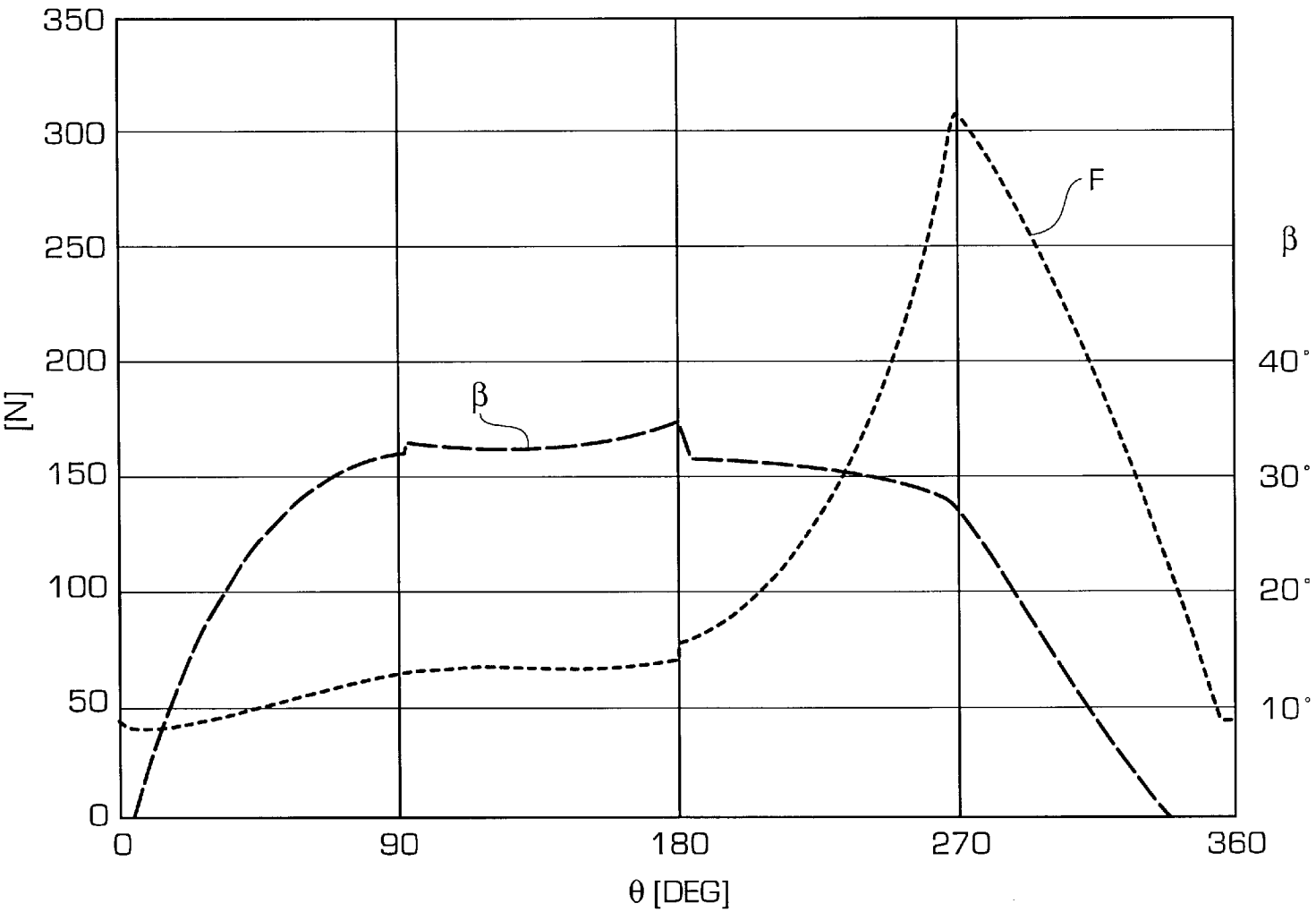
FIG. 9 is a graph showing the relation between the size of the force F and the direction $\beta$ of exertion of the force F to be applied to the inner peripheral surface of the roller to the rotation angle θ of the crank shaft of the rotary compressor of the second invention.

FIG. 9 shows an example of calculation showing the relation between the size of the force F to be exerted to the inner periphery of the roller 5 to the rotation angle $\theta$ of the crank shaft 1 and the direction $\beta$ in which the force F is exerted. As shown in FIG. 9, the force F to be exerted to the inner periphery of the roller 5 increases according to the compression of the cooling gas. The direction $\beta$ of the force F often comes under the 4th quadrant (in the range between 270 and 360 degrees of the rotation angle $\theta$ of the crank shaft 1), though there may be some differences depending on load and specifications. for this reason, when the oil feed hole 15 is open to the high load part of the inner periphery of the roller 5, the oil film pressure produced on the inner periphery of the roller 5 is lowered to cause aggravation to the lubrication state on the inner periphery of the roller 5. Accordingly, when the angle $\alpha$ of the center of the hole 22 to the center axis of reciprocation of the vane is assumed to be $\alpha \geqq 0$ in consideration of safety, the refrigerator oil (lubricant) is supplied from the light load side of the inner periphery of the roller 5 (in this calculation example, the force F is about ⅓ of that at the time of the peak) and the lubrication condition of the sliding surface between the tip of the vane 4 and the groove 6 becomes good, without causing loss to the lubricating condition of the inner periphery of the roller 5.

In this embodiment, there is shown an example of providing the holes 15 on two spots. However, depending on the length of the groove 6 in the lengthwise direction or the like, the number of the hole 15 may be determined. The sectional configuration may not be limited to circular but may be a slot.

In order to make it easy for the lubricant to spread over the sliding part or to facilitate removal of foreign matters, it is of course allowable to provide a fine groove on the groove 6 or a part or full length in the lengthwise direction at the tip of the vane 4 within the range not to give ill effect on the lubrication.

Furthermore, in case of the load on the inner periphery of the roller becoming light (load per unit area being small) as in the case of the lower high pressure system or the large diameter of the eccentric part, of course there may be cases where the amount of $\alpha$ can be used in negative position (to about several degrees).

(Embodiment 2)

Hereinafter, Embodiment 2 of the present invention is explained with reference to FIG. 10.

Figure 10:
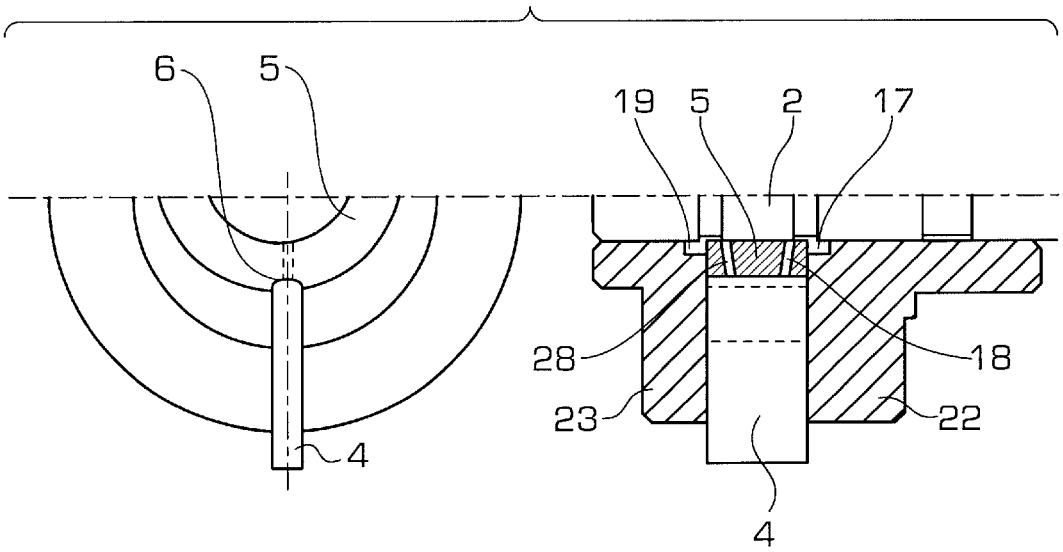
FIG. 10 is a partial sectional view showing a constitution of the mechanical part of the rotary compressor of embodiment 2 of the second invention.

In FIG. 10, the constitution comprises an oil chamber 17 formed by an inner periphery of the roller 5 and an end face of the main bearing 22 and the eccentric part 2, an oil feed hole 18 communicating with the groove 6 and the sliding part of the vane 4, an oil chamber 19 formed by the inner periphery of the roller 5, end face of the auxiliary bearing 23, and eccentric part 2, and an oil feed hole 28 communicating with the groove 6 and the sliding part of the vane 4. To the oil chambers 17 and 19 the refrigeration oil is supplied (led) at all times, and the oil is supplied to the groove 6 and the sliding part of the vane 4 through the oil feed holes 18 and 28.

As reviewed above, in the same manner as in Embodiment 1, the oil supply to the sliding surface of the tip of the vane 4 and the groove 6 is made through a very simple channel of passing through the oil feed holes 18 and 28 from the oil chambers 17 and 19, so that the gas is less apt to be pooled, and processing is simple.

In FIG. 10, there is shown an example of two channel flow passages, but it is of course allowable to adopt a single flow passage.

(Embodiment 3)

Hereinafter, Embodiment 3 of the present invention is explained with reference to FIG. 11.

Figure 11:
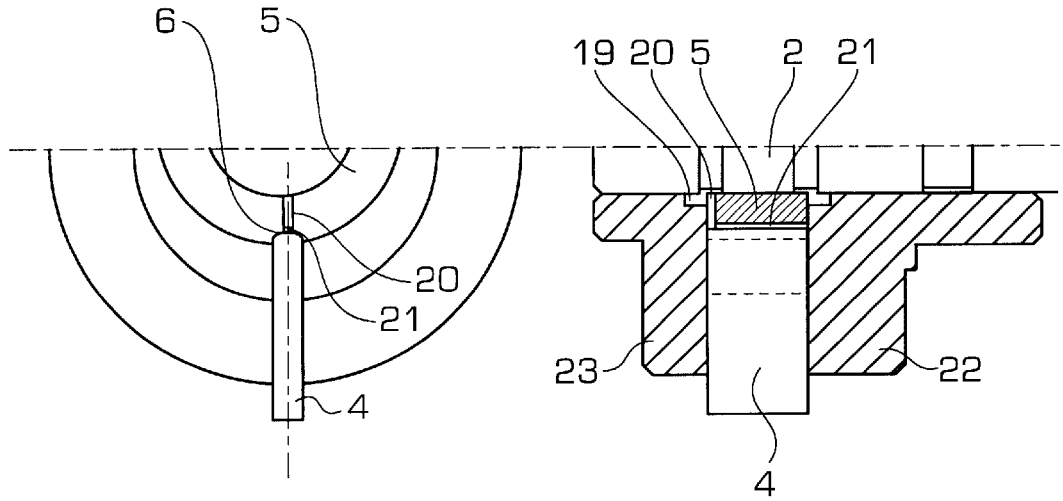
FIG. 11 is a partial sectional view showing a constitution of the mechanical part of the rotary compressor of embodiment 3 of the second invention.

As shown in FIG. 11, the constitution comprises an oil chamber 19 formed by an inner periphery of the roller 5, an end face of the auxiliary bearing 23, and an eccentric part 2, and a flow passage 20 communicating with the sliding part between the groove 6 and the vane 4 on the side surface of the roller 5, and a fine oil groove 21 provided in the lengthwise direction of the groove 6. To the oil chamber 19 the refrigeration oil is supplied (led) at all times, and the oil is supplied to the groove 6 and the sliding part of the vane 4 through the flow passage 20 to carry out stabilized lubrication.

In FIG. 11, description is made on the case where the flow passage (flow passage for supply of oil) 20 is single, but the case may not be limited to it but the flow passages may be provided for example on both sides of the roller 5. In FIG. 11, description is made on the case where the flow passage 20 is provided on the side surfaces of the roller 5, but the case may not be limited to it but the flow passage 20 may be provided on the end face side of the bearing with which the side surface of the vane 4 is in contact.

(Embodiment 4)

Hereinafter, Embodiment 4 of the present invention is explained with reference to the drawing.

Figure 12:
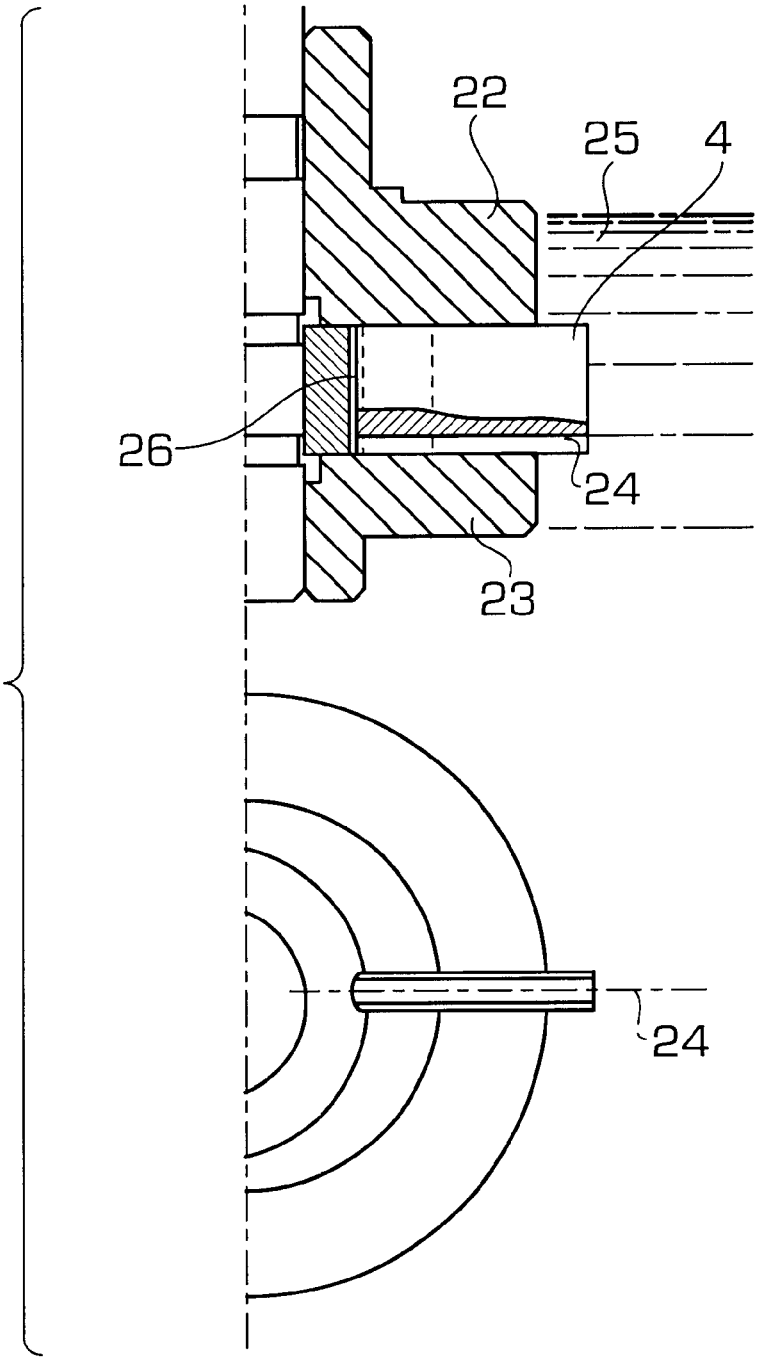
FIG. 12 is a partial sectional view showing a constitution of the mechanical part of the rotary compressor of embodiment 4 of the second invention.

As shown in FIG. 12, the embodiment comprises a flow passage 24 for oil supply having a width smaller than the thickness of the vane 4 provided on the side surface of the vane 4 in the lengthwise direction in which the vane 4 reciprocates, wherein the refrigerator oil 25 contained in the sealed container (not illustrated) is supplied to the sliding surface of the tip of the vane 4 and the groove 6 through a fine oil groove 26 provided in the lengthwise direction of the flow passage 24 and the groove 6 by pressure difference to carry out stabilized lubrication.

In FIG. 12, description is made on the case where the flow passage 24 is single, but without limited to it the flow passages may be provided for example on both sides of the vane 4. In FIG. 12, description is made on the case where the flow passage 24 is provided on the side surface of the vane 4, but without limited to it the flow passages may be provided on the end face sides of the bearings 22, 23 with which the side surface of the vane 4 is in contact.

As described above, according to the above Embodiments 1–4, there can be realized an easily workable rotary compressor having higher reliability and long life with assured lubrication by securing stabilized oil supply to the contact part between the vane and the roller without giving ill effect on other sliding part.

As apparent from the above description, the second invention has a strong point that it permits more stabilized oil supply to the sliding part between the vane and the roller in comparison with the conventional one.

Next, the embodiments of the third invention will be illustrated with reference to FIGS. 13 to 16.

Figure 17:
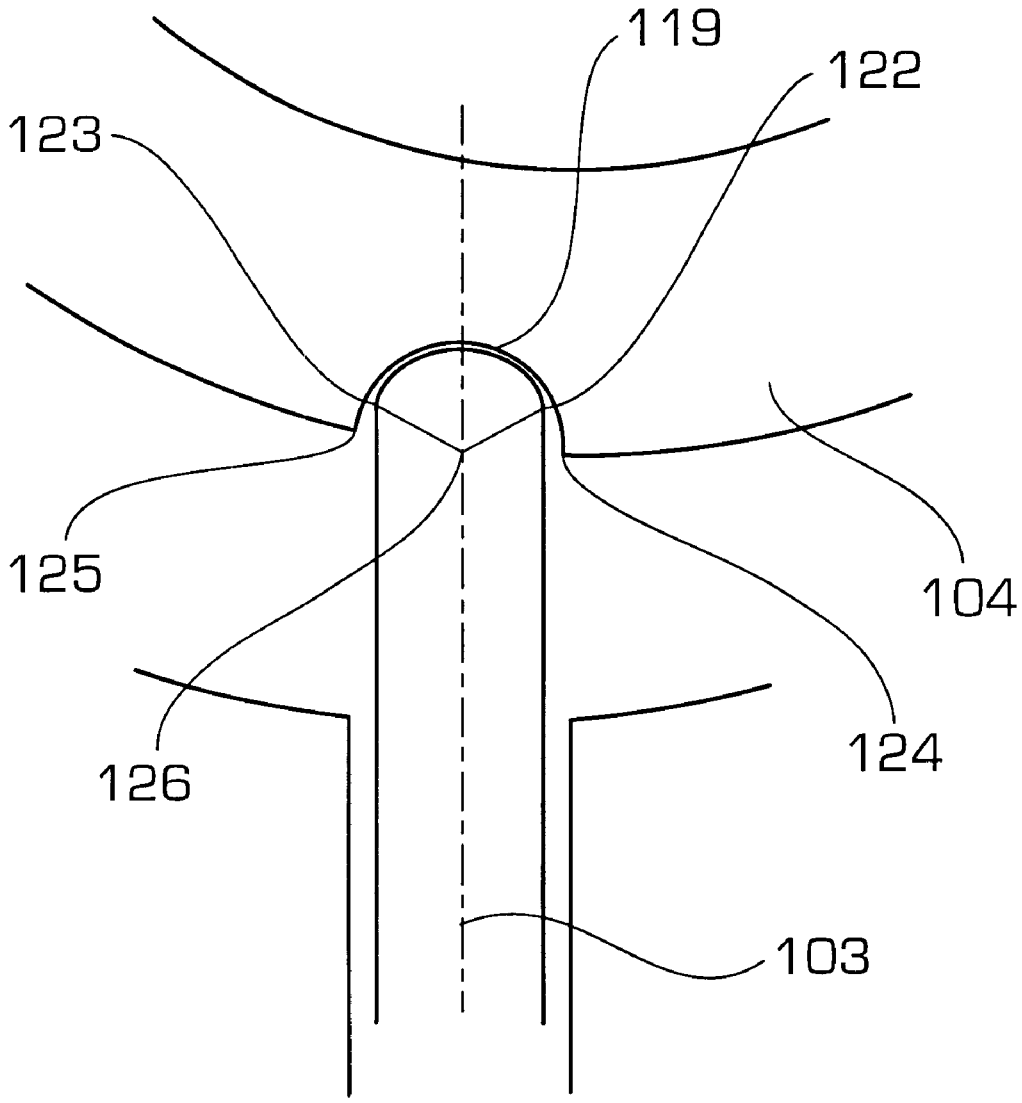
FIG. 17 is an enlarged side view of the essential part of the groove part of conventional rotary compressor.

The constitution of the rotary compressor according to an embodiment of the present invention is approximately the same as that of the conventional compressor as explained with reference to FIG. 17, except a part such as a roller and vane.

(Embodiment 1)

Figure 13:
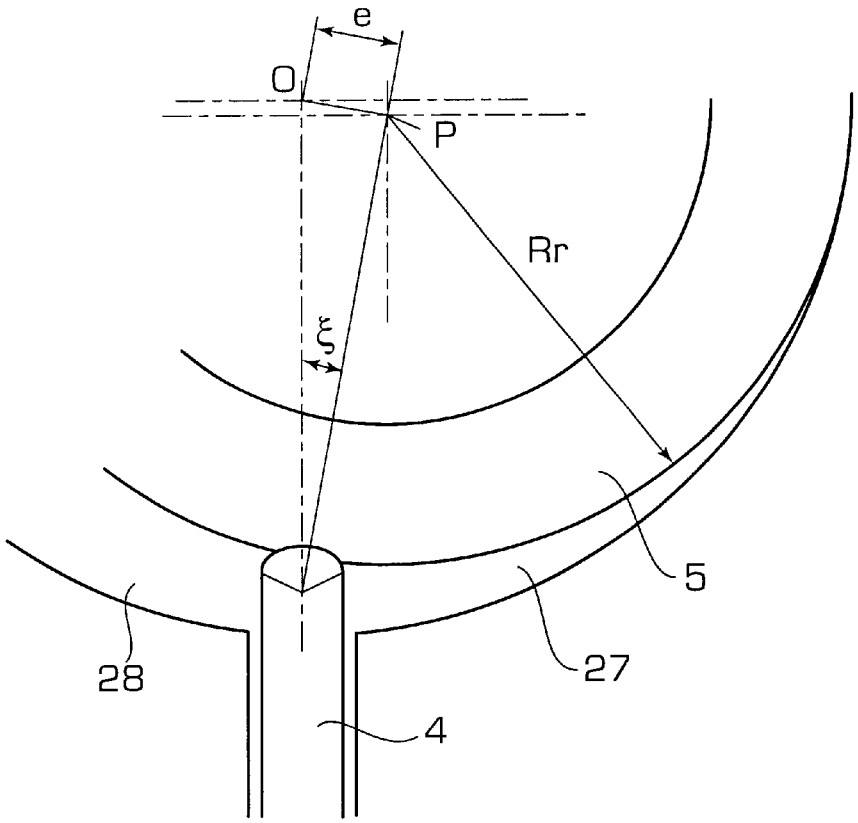
FIG. 13 is a view to show the positional relation between the vane and the roller at the time when the swinging angle of the roller becomes the maximum on the suction chamber side in embodiment 1 of the third invention.
Figure 14:
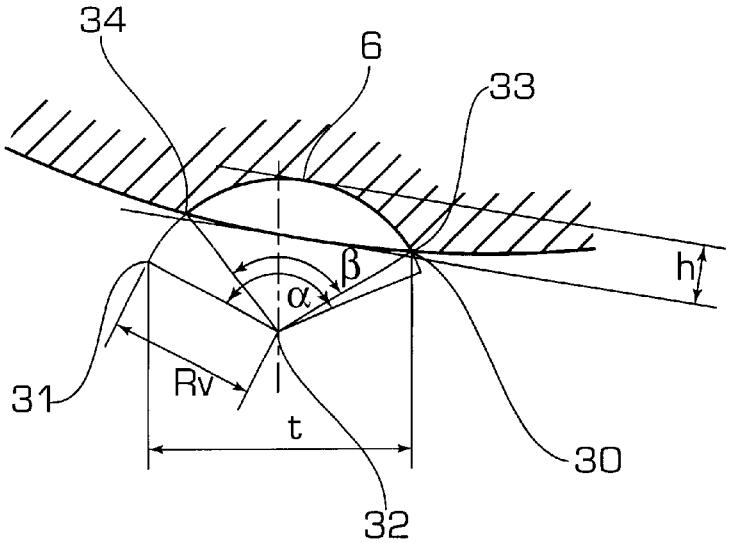
FIG. 14 is an enlarged side view of the essential part in the vicinity of the groove part at the time when the swinging angle of the roller becomes the maximum on the suction chamber side in embodiment 1 of the third invention.

FIG. 13 is a view to show the positional relation between the vane 4 and the roller 5 at the time when the swinging angle ξ of the roller 5 becomes the maximum on the suction chamber 27 side, and FIG. 14 is an enlarged side view of the part in the vicinity of the groove part 6 at that time. As shown in these figures, the roller 5 is provided with a groove 6 of R shape having approximately the same radius Rv as the R part at the tip of the vane 4 and arrangement is so made that the tip of the vane is swingable in the groove. Of the chambers partitioned with the vane 4, the part 27 is an suction chamber and 28 a discharge chamber. Using these data shown in the drawing, i.e., radius Rr of the roller 5, depth h of the groove 6, eccentricity e of the roller 5, radius Rv at the tip R of the vane 4, and thickness t of the vane 4, the swinging angle ξ of the roller 5 is expressed by:

$$\xi = \tan^{-1}\left(\frac{e}{Rr + Rv - h}\right) \quad \text{(Equation 1)}$$

The center angle α at the tip R of the vane 4 can be expressed by:

$$\alpha = 2\sin^{-1}\left(\frac{t}{2Rv}\right) \quad \text{(Equation 2)}$$

The center angle β of the groove 6 taken from the center 32 of the tip R of the vane 4 is expressed by:

$$\beta = 2\cos^{-1}\left(1 + \frac{h(h - 2Rv)}{2Rr(Rr + Rv - h)}\right) \quad \text{(Equation 3)}$$

The parts 33 and 34 are shoulders of the groove 6, i.e., the crossing points between the groove 6 and the outer periphery of the roller 6. The groove 6 is set to satisfy $\alpha/2-\beta/2>\xi$. Other constitutions are the same as those of conventional example. By such constitution, following one turn of the crank shaft 1, the roller 5 carries out eccentric swinging movements in the cylinder 3 according to the movements of the crank shaft 1 and the eccentric part 2, and accordingly the R part at the tip of the vane 4 and the groove 6 show contact movements by the swinging motion. Also, by satisfying the conditions of $\alpha/2-\beta/2>\xi$, when the swinging angle ξ of the roller 5 becomes the largest to the suction chamber 27 side as shown in FIG. 14, the edge 30 of the vane 4 on the suction chamber 27 side is positioned outside the groove 6. Similarly, when the swinging angle $\xi$ of the roller 5 becomes the largest to the discharge chamber 28 side, the edge 31 of the vane 4 on the discharge chamber 28 side is positioned outside the groove 6. Accordingly, as the edges 30 and 31 of the vane 4 are at all times positioned outside the groove 6 in the swinging movement, the edges 30 and 31 of the vane 4 do not come into contact with the groove 6, so that the wear by contact sliding of the edges 30 and 31 of the vane 4 in the groove 6 can be prevented, and highly reliable rotary compressor can be obtained.

With respect to the configuration of the groove 6, assuming the center angle of the shoulder part of the groove 6 viewed from the center 32 of the tip R of the vane 4 to be $\beta'$, if the foregoing $\xi$, $\alpha$and $\beta'$ satisfy the equation: $\alpha/2-\beta'/2>\xi$, then it is possible to give the same effect as in the case of the foregoing groove 6 with the R shape having the different radius from the tip R part of the vane 4 or polygonal cross-section such as rectangular shape, in addition to the above.

(Embodiment 2)

Figure 15:
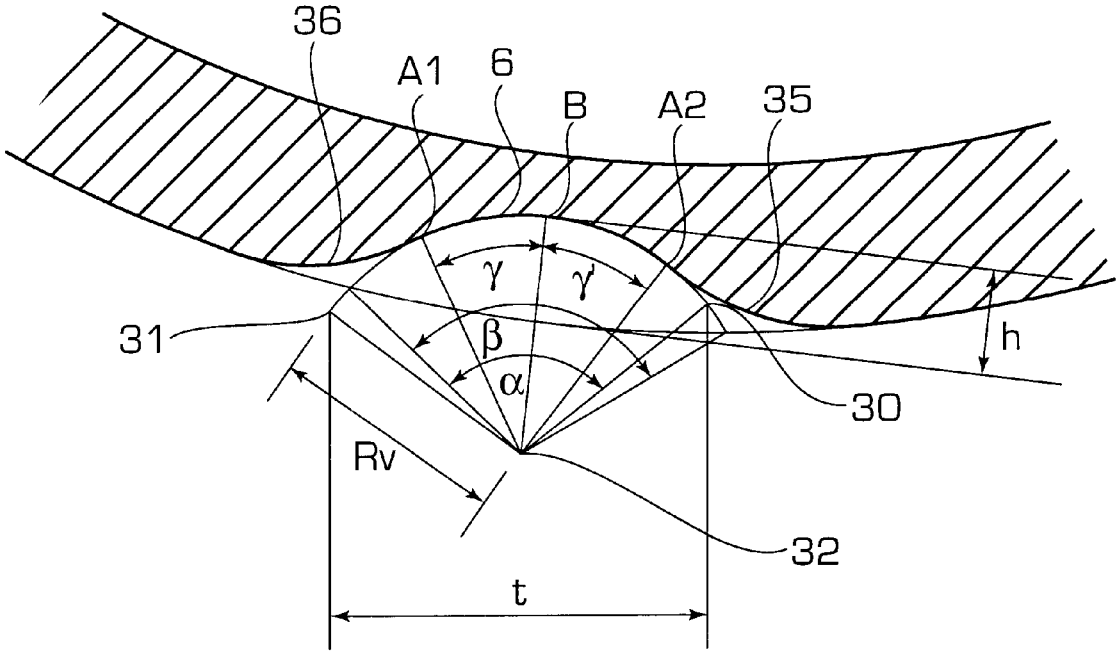
FIG. 15 is an enlarged side view of the essential part in the vicinity of the groove part at the time when the swinging angle of the roller becomes the maximum on the suction chamber side in embodiment 2 of the third invention.

FIG. 15 is an enlarged view of the part in the vicinity of the groove part 6 at the time when the swinging angle $\xi$ of the roller becomes the maximum on the suction chamber side. As shown in these figures, the roller 5 is provided with a groove 6 of R shape having approximately the same radius Rv as the R part at the tip of the vane 4 and arrangement is so made that the tip of the vane is swingable in the groove 6. Using these data shown in the drawing, i.e., radius Rr of the roller 5, depth h of the groove 6, eccentricity e of the roller 5, radius Rv at the tip R of the vane 4, and thickness t of the vane 4, the swinging angle $\xi$ of the roller 5 is expressed by Equation 1, the center angle $\alpha$ of the R part at the tip of the vane 4 is expressed by Equation 2, and the center angle $\beta$ of the groove 6 viewed from the center 32 of the tip R of the vane 4 is expressed by Equation 3. The groove 6 is set up to satisfy the conditions of $\alpha/2-\beta/2\leqq\xi$. At this time, the constitution is such that on the shoulder of the groove 6 there are provided the R parts 35 and 36 crossing the groove 6 at the position A1 which satisfies $\gamma<\alpha/2-\xi$ and at the position A2 which satisfies $\gamma'<\alpha/2-\xi$ in respect to the angles $\gamma$ and $\gamma'$ from the bottom B of the groove 6 observed from the center of R at the tip of the vane 4. Other constitutions are the same as those of conventional example. By such constitution, following one turn of the crank shaft 1, the roller 5 carries out eccentric swinging movements in the cylinder 3 according to the movements of the crank shaft 1 and the eccentric part 2, and accordingly the R part at the tip of the vane 4 and the groove 6 show contact movements by the swinging motion. Also, by the provision of the R parts 35, 36 on the shoulder of the groove 6, when the swinging angle $\xi$ of the roller 5 becomes the largest to the suction chamber 27 side as shown in FIG. 15, the edge 30 of the vane 4 on the suction chamber 27 side is positioned on the R parts 35 of the groove 4, and does not come into contact with the groove 6. Similarly, when the swinging angle $\xi$ of the roller 5 becomes the largest to the discharge chamber 28 side, the edge 31 of the vane 4 on the discharge chamber 28 side is positioned on the R part of the shoulder of the groove 6 and is not in contact with the groove 6. Accordingly, as the edges 30 and 31 of the vane 4 are at all times not in contact with the groove 6 in the swinging movement, wear caused by contact sliding of the edges 30 and 31 of the vane 4 in the groove 6 can be prevented, and highly reliable rotary compressor can be obtained. Needless to say, the R parts 35, 36 may be replaced with the chamfering parts to give the similar effects. Or instead of forming of the R parts 35, 36, such constitution can be realized that R parts or chamfering parts can be formed at the edges 30, 31 of the vane 4 at the suction chamber 27 or the discharge chamber 28 in order to make the edges 30,31 not contacting with groove 6 to give the similar effects. Or both constitutions can be combined to give the similar effects.

By the setting of the R part of shoulder of the groove 6 and so on, it becomes easier for the oil to be supplied to the gap between the vane 4 and the groove 6 during the normal operation and wear of the groove 6 and the R part at the tip of the vane 4 can be reduced, and these effects lead to the further improvement of reliability of the rotary compressor.

(Embodiment 3)

Figure 16:
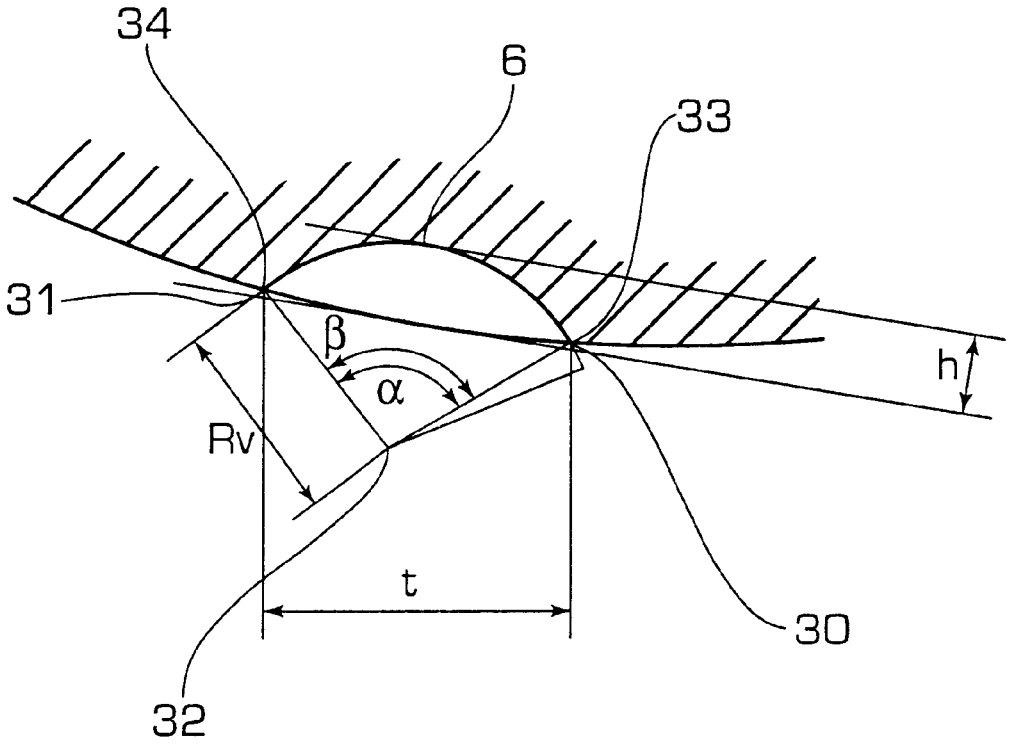
FIG. 16 is an enlarged side view of the essential part in the vicinity of the groove part at the time when the swinging angle of the roller becomes the maximum on the suction chamber side in embodiment 3 of the third invention.

FIG. 16 is an enlarged side view of the part in the vicinity of the groove part 6 at the time when the swinging angle $\xi$ of the roller becomes the maximum on the suction chamber side. As shown in the figure, the roller 5 is provided with a groove 6 of R shape having approximately the same radius Rv as the R part at the tip of the vane 4 and arrangement is so made that the tip of the vane is swingable in the groove 6. In this case, the center position 32 of the R part at the tip of the vane 4 is set to be nearer toward the discharge chamber 28 side from the center in the thickness direction of the vane, so that when the swinging angle $\xi$ of the roller becomes the maximum on the suction chamber 27 side, the edge 30 of the vane 4 on the suction chamber 27 side is positioned outside the groove 6, as shown in FIG. 16. Other constitutions are the same as those of conventional example. The parts 33 and 34 are the shoulders of the groove 6. By such constitution, following one turn of the crank shaft 1, the roller 5 carries out eccentric swinging movements in the cylinder 3 according to the movements of the crank shaft 1 and the eccentric part 2, and accordingly the R part at the tip of the vane 4 and the groove 6 show contact sliding by the swinging motion. In the process of this contact sliding, the edge 30 on the suction chamber 27 side of the vane 4 is positioned at all times outside the groove 6. Accordingly, in the swinging movement, the edge 30 on the suction chamber 27 side of the vane 4 does not come into contact with the groove 6, so that the wear by contact sliding of the groove 6 with the edge 30 on the suction chamber 27 side can be prevented, making it possible to obtain highly reliable rotary compressor.

Furthermore, by providing a shoulder 34 on the discharge side of the groove 6 as shown in Embodiment 2, sliding movement on the discharge side can be prevented and lubrication to the tip of the vane can also be realized. Accordingly, the rotary compressor having higher reliability can be provided.

As will be apparent from the above explanation, in the third invention, by constituting so that at least the edge on the suction chamber side out of the edges constituting the crossing point between the tip R part of the vane and the side surface does not come into contact with the groove in the eccentric swinging movement of the roller, wear of the groove part can be reduced, thereby making it possible to realize a rotary compressor that shows high reliability.

Next, the embodiments of the fourth invention will be illustrated.

The constitution of the rotary compressor according to each embodiment of the fourth invention is approximately the same as that of the conventional compressor, except a part such as a groove.

(Embodiment 1)

Hereinafter, with respect to Embodiment 1 of the present invention, explanation is given with reference to FIG. 18 as well as FIG. 19 and FIG. 20 which are enlarged views of the part A thereof.

Figure 18:
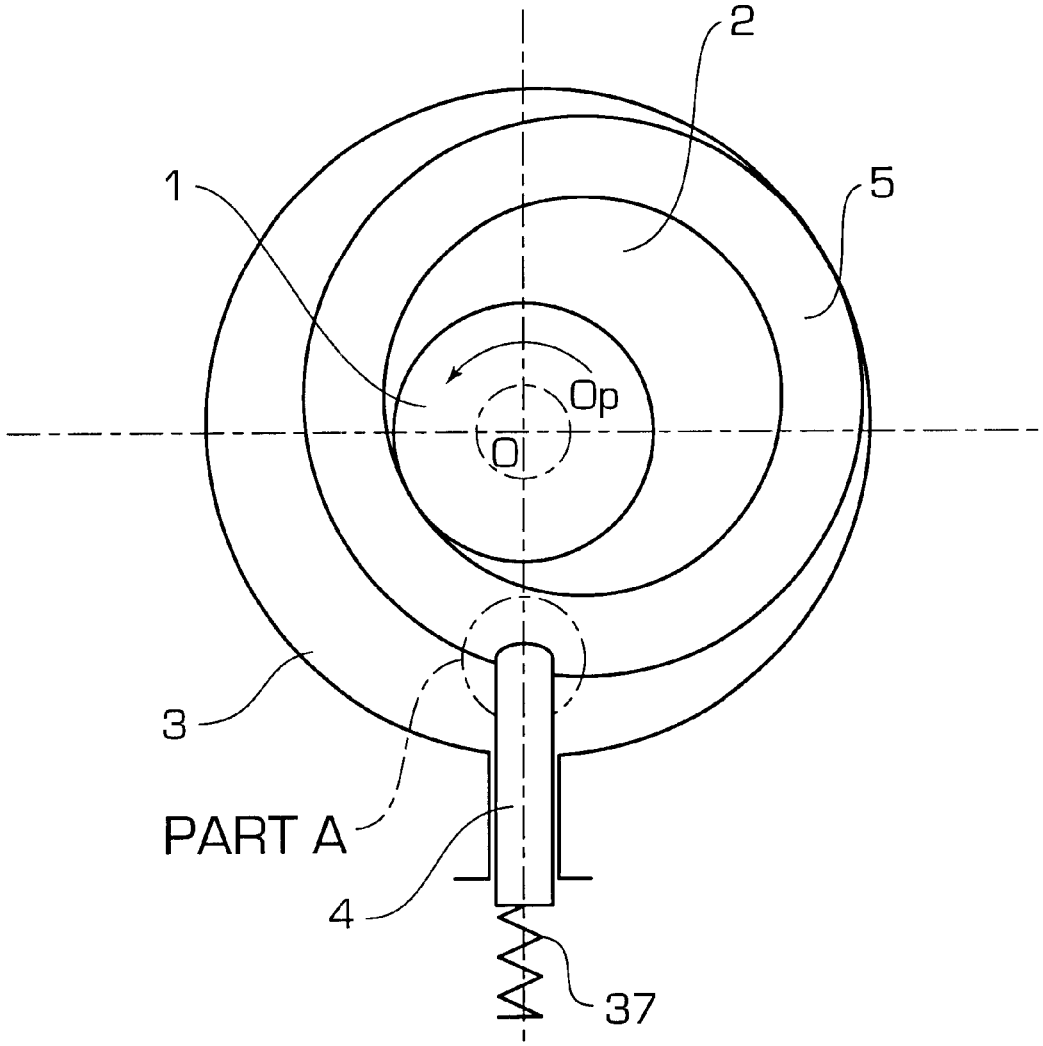
FIG. 18 is a sectional view of the main compressing mechanical part of the rotary compressor of the embodiment of the fourth invention.
Figure 19:
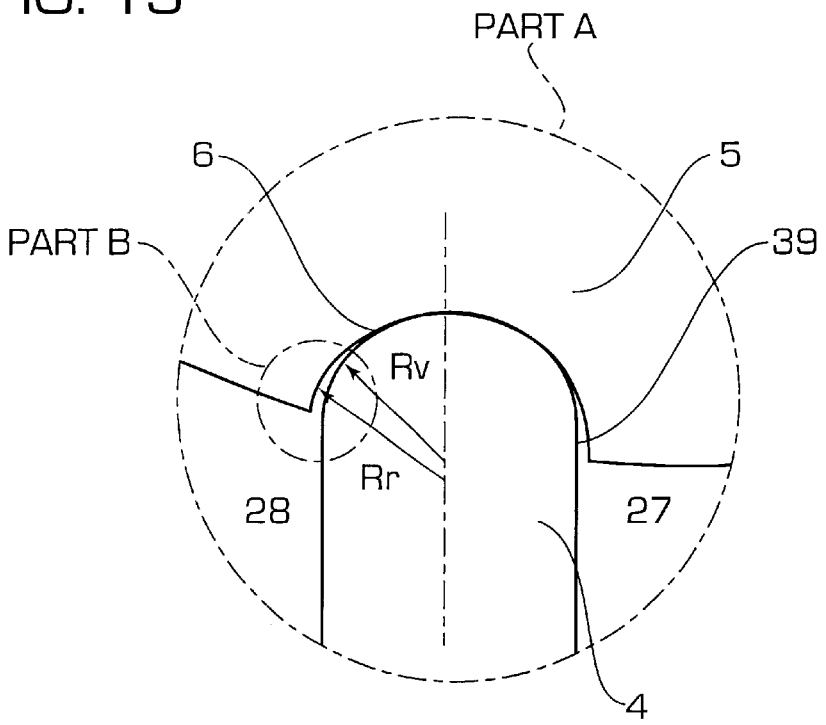
FIG. 19 and FIG. 20 are sectional views of the essential part of the vane/roller of the rotary compressor of embodiment 1 of the fourth invention.
Figure 20:
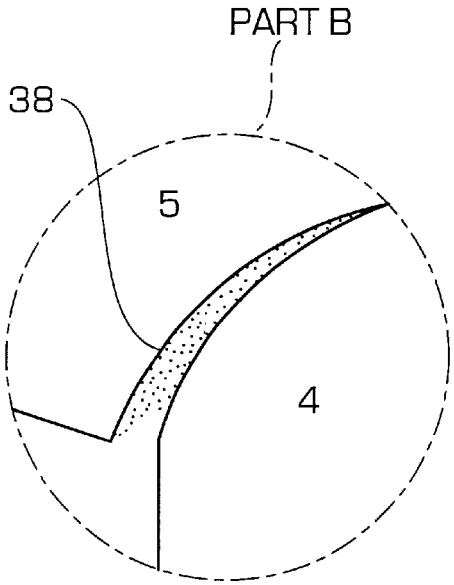

As shown in FIGS. 18, 19, and 20, the rotary compressor of this invention is characterized by comprising a cylinder 3, a crank shaft 1 having an eccentric part 2, a bearing (not illustrated) which rotatably supports said crank shaft 1, a roller 5 which moves (revolves) in said cylinder 3 following said eccentric part 2, a vane 4 whose all or part of the tip is of R configuration, and a groove having approximately the same R shape at the tip R of said vane 4 disposed on the outer peripheral surface of the roller 5, with the tip of said vane 4 being disposed slidably in Contact in said groove 6. The part 37 is a spring.

The radius Rr of the groove is slightly larger than the radius Rv at the tip R of the vane 4, and further the radius Rv of the R at the tip of said vane 4 and the radius Rr of said groove part 6 are constituted in the relations of:

(Equation 4)

$$0<(Rr-Rv)/Rr<0.1.$$

By adopting such a constitution, it becomes possible to enlarge the pressure sustaining area of the sliding part between the tip of the vane 4 and the groove 6 and to reduce the load at the sliding part.

Furthermore, when the wedge shaped gaps 38, 39 are formed in the sliding direction of the tip of the vane 4 and the groove 6 and the tip of the vane 4 and the groove 6 show mutual sliding movements, the oil existing in the discharge chamber 28 or refrigerant atmosphere in the suction chamber 27 produces hydraulic pressure by wedge effect in the wedge shaped gaps 38, 39, and further moves slightly (right and left directions) in the range shown in Equation 4 to produce the hydraulic pressure by the respiration effect (squeeze effect). As a result, the lubricating condition at the sliding part between the vane and the roller is improved to give highly reliable compressor.

If the gap is too large, lowering of efficiency by increase of dead volume and generation of noise by lateral vibration become non-negligible, so that the gap is controlled within the range of Equation 4.

(Embodiment 2)

Hereinafter, Embodiment 2 of the fourth invention is explained with reference to FIG. 21.

Figure 21:
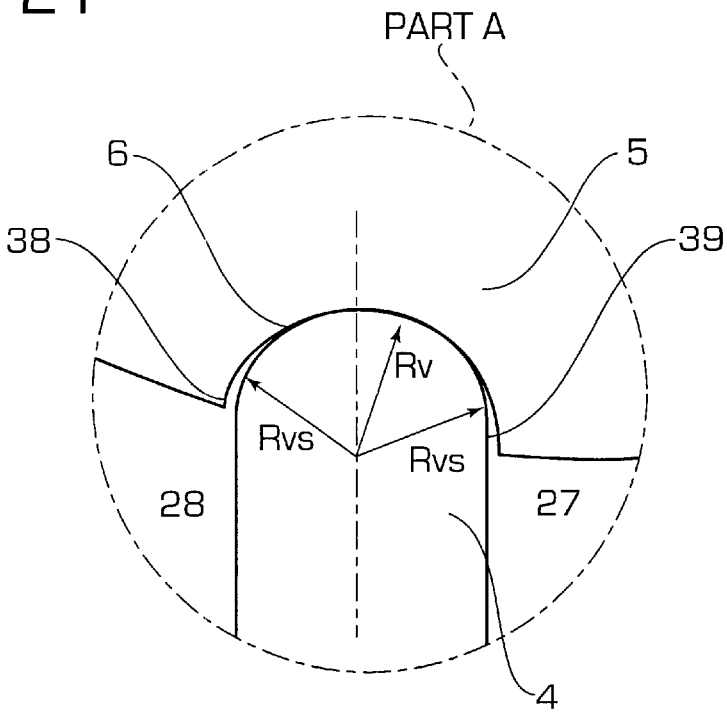
FIG. 21 is a sectional view of the essential part the vane/roller of the rotary compressor of embodiment 2 of the fourth invention.

In FIG. 21, on the vane tip part positioned on the vane lateral side within the tip shape of vane 4, an R processing of Rvs which is different from the radius Rv at the central part is provided, and there are provided an R shaped groove 6 provided on the outer periphery of the roller 5 and wedge shaped gaps 38, 39. By such constitution, the wedge effect similar to that of Embodiment 1 can be expected.

In this embodiment there is shown an example of the case of radius Rvs different from the central part radius Rv at the tip part of the vane positioned on the vane lateral side. However, in place of Rvs, chamfering may be applied, and of course the right and left radii Rvs may be different from each other.

(Embodiment 3)

Hereinafter, Embodiment 3 of the fourth invention is explained with reference to FIG. 22.

Figure 22:
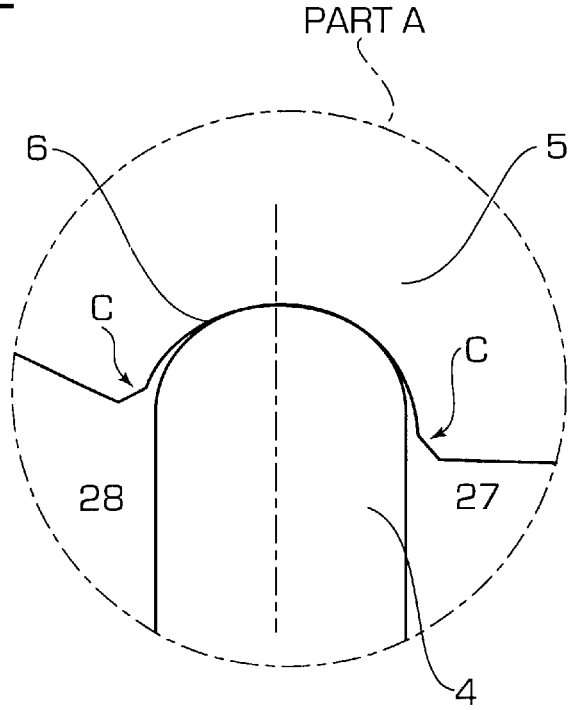
FIG. 22 is a sectional view of the essential part the vane/roller of the rotary compressor of embodiment 3 of the fourth invention.

As shown in FIG. 22, this embodiment has a constitution that the chamfering C is provided on the crossing part between the R part of the groove 6 and the outer periphery of the roller 5.

By adopting such a constitution, the oil in the discharge chamber 28 or in the suction chamber 27 is smoothly supplied to the sliding part between the tip of the vane 4 and the groove 6, thereby serving to improve lubrication.

In FIG. 22, chamfering is applied, but R processing may be provided, or of course the processing may be made in combination with Embodiment 1 or 2.

(Embodiment 4)

Hereinafter, Embodiment 4 of the fourth invention is illustrated with reference to FIG. 23.

Figure 23:
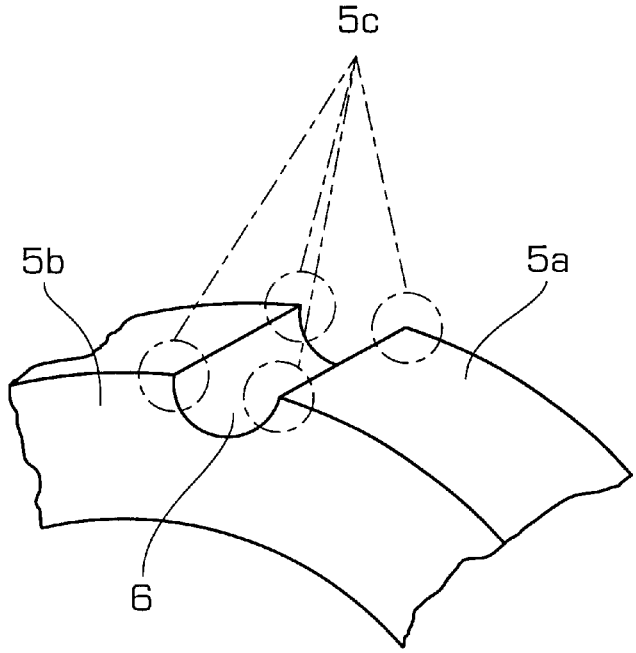
FIG. 23 is a perspective view of the essential part the roller part of the rotary compressor of embodiment 4 of the fourth invention.

As shown in FIG. 23, the 5*c* parts (four spots) which are the crossing points between the R part of groove 6, the outer peripheral surface 5*a* of the roller, and the lateral surface 5*b* of the roller, are provided with small R processing or chamfering to remove angle (edge).

By adopting such a constitution, even if the roller 5 swings in inclination in the range of the clearance, the angle 5*c* part does not damage the bearing end face on which the roller side surface 5*b* slides (ref. FIG. 8 above).

(Embodiment 5)

Hereinafter, Embodiment 5 of the fourth invention is explained with reference to FIG. 24.

Figure 24:
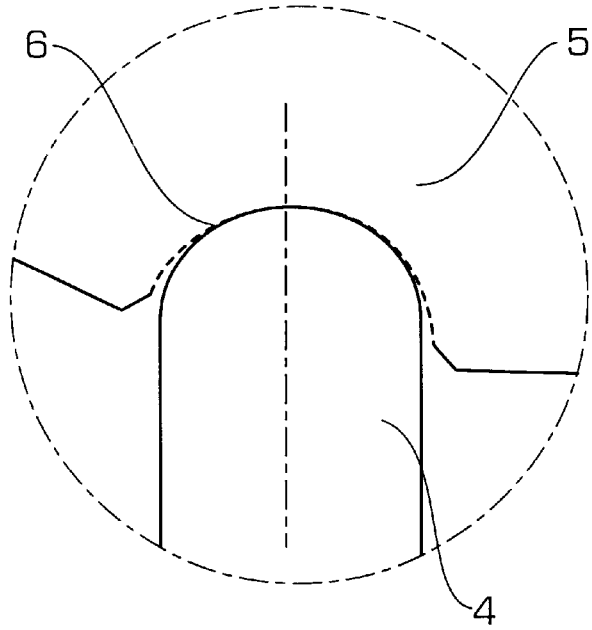
FIG. 24 is a sectional view of the essential part the vane/roller of the rotary compressor of embodiment 5 of the fourth invention.

In FIG. 24, there is shown an example of the use of a material or surface treatment wherein the hardness of the tip part of the vane 4 is harder than the hardness of the groove 6, the groove 6 is constituted by a material having good fitting, and the surface of the tip part of the vane 4 is finished more smoothly (in finer surface roughness) than the groove part 6.

By adopting such a constitution, on the surface of the groove part 6 the concordance wear (so-called initial concordance) progresses by the tip part of the vane 4 in the initial stage of the operation and it is unnecessary to elevate processing accuracy on the surface of the groove 6 to a large degree in processing. Accordingly, the number of the processing steps can be reduced.

In the present embodiment, the hardness of the tip side of the vane 4 is increased, but needless to say, the hardness of the surface of the groove 6 may be increased. In short, the relation between the tip part of the vane and the groove part may be relatively reverse in all or a part of the hardness, fitting characteristics, and smoothness.

As will be apparent from the above description, the present invention permits to realize a rotary compressor which can be easily processed, and is operable by positively generating hydraulic pressure to the contact part between the vane and the roller without giving ill effect on other sliding part with smooth lubrication between the sliding parts, thereby providing higher reliability and extended life to the compressor.

What is claimed is:

1. A rotary compressor comprising:

a cylinder, a crank shaft having an eccentric part disposed in said cylinder, a bearing which rotatably supports said crank shaft, a roller which moves in said cylinder following said eccentric part, and a vane having a tip which is circular in cross section with a radius $R_v$, wherein a groove is provided on a part of the outer periphery of said roller, with the tip of said vane being disposed in contact swingably in said groove, and a wedge shaped gap formed in a predetermined relation between said tip of the vane and said groove in the sliding direction thereof.

2. A rotary compressor according to claim 1, wherein a flat surface is formed on a part of the longitudinal length or on full length of the R shaped part at the tip of said vane, wherein said flat surface is provided by flattening said tip which is circular in cross section with a radius R.

3. A rotary compressor according to claim 1, wherein fine oil grooves are formed on a part of the longitudinal length or full length of the between said groove and said vane tip.

4. a rotary compressor according to claim 1, wherein a refrigerant not containing chlorine is used as a refrigerant.

5. A rotary compressor according to claim 1, wherein the radius of said tip of the vane which is circular in cross section is denoted by Rv; the inner surface of said groove is circular in cross section; the radius of said inner surface is denoted by Rr; and said predetermined relation is expressed by $$0<(Rr-Rv)/Rr<0.1.$$

* * * * *

UNITED STATES PATENT AND TRADEMARK OFFICE

CERTIFICATE OF CORRECTION

PATENT NO. : 6,409,488 B1
DATED : June 25, 2002
INVENTOR(S) : Ikoma et al.

It is certified that error appears in the above-identified patent and that said Letters Patent is hereby corrected as shown below:

Column 16,
Line 56, please delete subscript "v" from "R".

Line 62, after "thereof" please add: -- and wherein the radius of said tip of the vane is denoted by Rv, the inner surface of said groove is circular in cross section, the radius of said inner surface is denoted by Rr, and said predetermined relation is expressed by $0 < (Rr-Rv)/Rr < 0.1$ --.

Column 17,
Line 3, after "the" please add -- surface --.

Column 18,
Line 4, please capitalize the first "a".

Signed and Sealed this

Eighth Day of July, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,409,488 B1
DATED : June 25, 2002
INVENTOR(S) : Mitsuhiro Ikoma et al.

It is certified that error appears in the above-identified patent and that said Letters Patent is hereby corrected as shown below:

Column 17,
Line 6, delete "according to claim 1," and insert -- comprising:

a cylinder,
a crank shaft having an eccentric part disposed in said cylinder,
a bearing which rotatably supports said crank shaft,
a roller which moves in said cylinder following said eccentric part, and
a vane having a tip which is circular in cross section with a radius R,
wherein a groove is provided on a part of the outer periphery of said roller, with the tip of said vane being disposed in contact swingably in said groove, and a wedge shaped gap formed in a predetermined relation between said tip of the vane and said groove in the sliding direction thereof, wherein a flat surface is formed on a part of the longitudinal length or on the full length of the R shaped part at the tip of said vane, wherein said flat surface is provided by flattening said tip which is circular in cross section with a radius R, wherein fine oil grooves are formed on a part of the longitudinal length or the full length of the surface between said groove and said vane tip, wherein a refrigerant not containing chlorine is used as a refrigerant, and --

Signed and Sealed this

Seventeenth Day of February, 2004

JON W. DUDAS
*Acting Director of the United States Patent and Trademark Office*